US006819037B2

(12) United States Patent
Hendriks et al.

(10) Patent No.: US 6,819,037 B2
(45) Date of Patent: Nov. 16, 2004

(54) DISPLAY ARRANGEMENT WITH REDUCED MECHANICAL STRESS

(75) Inventors: Arnoldus Antonius Maria Hendriks, Eindhoven (NL); Theodoor Christiaan Anna Hens, Eindhoven (NL); Wilhelmus Marinus Maria Van De Steen, Eindhoven (NL); Rudolf Maria Jozef Voncken, Eindhoven (NL); Jean Winters, Eindhoven (NL); Maurice Andreas Wilhelmina Deuss, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 171 days.

(21) Appl. No.: 10/101,330

(22) Filed: Mar. 19, 2002

(65) Prior Publication Data

US 2002/0190626 A1 Dec. 19, 2002

(30) Foreign Application Priority Data

Mar. 22, 2001 (EP) ..... 01201075

(51) Int. Cl.[7] ..... H01J 28/80
(52) U.S. Cl. ..... 313/402; 313/407; 313/404
(58) Field of Search ..... 313/402, 407, 313/403, 404, 405, 406

(56) References Cited

U.S. PATENT DOCUMENTS

| | | | | |
|---|---|---|---|---|
| 3,516,147 A | | 6/1970 | Seedorff et al. | |
| 4,472,657 A | * | 9/1984 | Sakurai et al. | 313/402 |
| 5,103,132 A | | 4/1992 | Van Der Bolt et al. | 313/402 |
| 6,528,933 B1 | * | 3/2003 | Reyal | 313/407 |

FOREIGN PATENT DOCUMENTS

| | | | |
|---|---|---|---|
| EP | 0599400 A1 | 6/1994 | H01J/9/14 |
| JP | 56003946 | 6/1979 | H01J/29/07 |
| JP | 01151131 | 6/1989 | H01J/20/07 |

* cited by examiner

*Primary Examiner*—Edward J. Glick
*Assistant Examiner*—Elizabeth Keaney

(57) ABSTRACT

A display arrangement includes a cathode ray tube, inside which tube a mask with at least one curved outer edge is located. The mask is at least partly attached by at least part of the curved edge to the tube by means of at least a diaphragm arrangement. The diaphragm arrangement includes at least one diaphragm part in the form of an elongated folded sheet including a straight fold, said sheet extending from the straight fold to a curved fold and from the curved fold to a curved part of the sheet for attaching to the curved mask edge. Preferably, the straight fold has a varying folding angle and the curved fold follows a curve which enables the transition from the straight fold to the curved fold to provide a folded sheet which is free from inherent mechanical stress.

20 Claims, 5 Drawing Sheets

DISPLAY ARRANGEMENT WITH REDUCED MECHANICAL STRESS

Figure 1:
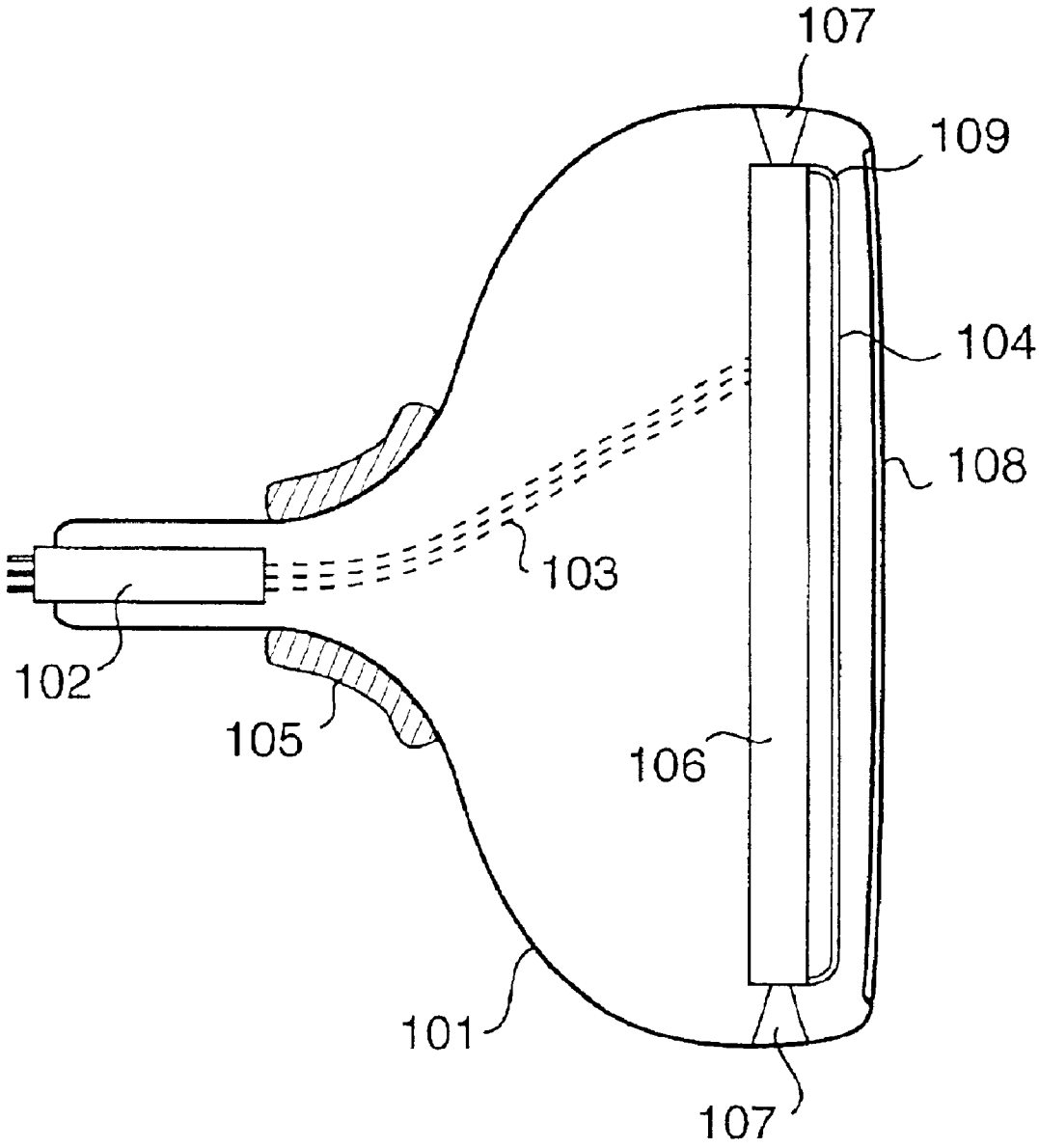

The present invention relates generally to an arrangement for improving the quality of a picture display system. In particular, the invention relates to an arrangement that is attached to a shadow mask and a method of manufacturing such an arrangement.

There is hardly any doubt that the problem of improving picture quality in color display systems, such as those utilized in domestic TV-sets, is of paramount importance and a focus of interest to a global visual media audience. As the quality of the systems for storing and providing signals representing visual media improves, the devices for reproducing the signals are obviously also required to improve in terms of their reproduction capacity. A typical example is the introduction of the digital versatile disc (DVD) and other digital image storage means that are now beginning to replace the video tape technology that has been used for several decades.

Regardless of the improvements that have been made in signal storage and processing technology, most display systems still utilize the technology of evacuated cathode ray tubes (CRT). Such systems comprise a multitude of electric components such as electron beam generating means, control circuitry and deflection coils as well as mechanical constructional elements such as a shadow mask. A shadow mask comprises a thin metal sheet having, for instance, a curved shape with a multitude of apertures through which the electron beams pass on their way to a phosphorus layer on the inner side of the display screen where a picture is obtained.

The shadow mask must remain mechanically stable in order to make sure that the electron beams reach the proper location, i.e. phosphor dot of the proper color, resulting in a picture having good color purity. Mechanical instability may occur due to externally induced vibrations as well as the buildup and release of mechanical stress due to heat transfer to and from the mask.

In order to attach the shadow mask to the CRT, while preserving a measure of mechanical stability, a prior art arrangement, U.S. Pat. No. 5,103,132, shows a mask that is attached to four frame parts in the form of stepped profiles. The stepped profiles are attached to each other so as to form a frame by means of connecting elements at the corners formed by the frame parts.

Although the arrangement shown in U.S. Pat. No. 5,103,132 may reduce negative effects relating to vibrations (microphony), the frame is not insensitive to negative effects caused by the release of mechanical stress inherent in the frame parts. Due to the fact that the frame parts are attached, e.g. by spot welds, to the curved skirt of the shadow mask, the frame will have inherent mechanical stress which may be released in an unpredictable manner when the mask is subject to external vibrations, shocks and thermally induced expansion and contraction.

An object of the present invention is to overcome problems related to prior art display arrangements as exemplified by the cited U.S. Pat. No. 5,103,132. In general terms, one problem to be solved is hence how an improved picture display system can be obtained. Another problem to be solved is how a display arrangement with improved resistance to thermal variations can be obtained.

The present invention provides a solution to these problems in that, according to a first aspect, it provides a display arrangement comprising a cathode ray tube, inside which tube a mask with at least one curved outer edge is located.

The mask is at least partly attached by at least part of the curved edge to the tube by means of at least a diaphragm arrangement. The diaphragm arrangement comprises at least one diaphragm part in the form of an elongated folded sheet with a reduced level of in-plane mechanical stress. The sheet comprises a straight fold, and extends from the straight fold to a curved fold. The sheet further extends from the curved fold to a curved part of the sheet for attaching to the curved mask edge.

The invention further provides a solution to the problems stated in that it provides a diaphragm arrangement for use in such a display arrangement.

Yet an other aspect of the present invention provides a method of manufacturing a diaphragm part in the form of an elongated sheet, with a reduced level of in-plane mechanical stress, for use in such a display arrangement. The method comprises the steps of creating a straight fold and creating a curved fold such that the sheet extends from the straight fold to the curved fold, and such that the sheet extends from the curved fold to a curved part of the sheet for attaching to the curved mask edge.

Preferably, the straight fold has a varying folding angle and the curved fold follows a curve which enables the transition from the straight fold to the curved fold to provide a folded sheet which is free from inherent mechanical stress. The folds themselves will have a certain level of negligible inherent stress, but the sheet extending between the folds will be stress-free.

The diaphragm arrangement can thus be seen as an arrangement comprising three different sections: a curved section which follows the contour of the mask, a rectangular section which serves as a frame and a transition section between the curved section and the rectangular section. The function of the transition section is to act as a bridge between the curved section and the rectangular section.

An advantage of the invention is that it provides a stress-free diaphragm for holding the shadow mask. The implications for the function of the display system are that, by virtue of its dimensional accuracy, the mask and the diaphragm parts are more accurately fitted with respect to each other, and resistance to deformation during thermal cycling between low and high temperatures is obtained. This also means that there is a minimal deformation of the assembly of the mask and the diaphragm, which improves microphony damping and reduces the landing spread.

Apart from providing a stress-free diaphragm for holding the shadow mask, an arrangement according to the invention also has the advantage that it enables substantial freedom of design. The dimensions of the mask and the frame, i.e. the diaphragm, may differ significantly such that the mask may be either smaller or larger than the diaphragm. Although the mask may have virtually any reasonable curvature radius, it still allows a simple design of the diaphragm parts.

Another advantage of the present invention is that it allows a robust manufacturing method in that it is easy and provides a predictable end result. It is easy to reach the desired geometry in the folding steps. The resulting spread in the geometry of the manufactured parts is small and less dependent, as compared to prior art methods, on the pressure force used in the folding tool. In particular the inventive method enables a significant reduction to be achieved of the force needed to fold the parts, as compared to prior art methods, because of the fact that there is no deformation stress or strain in the sheet itself. This also means that the tool used for folding is less subject to degradation and hence requires less maintenance and repair, and said tool removes the need for hardened tools, and enables a large quantity of parts to be manufactured before being subject to degradation. This in turn allows easy manufacture or re-design of the folding tool, which means that the speed of a prototype-manufacturing process may be increased significantly and at a smaller cost as compared to previous methods where hardened tools must be used.

FIG. 1 schematically shows a cross-sectional view of a display arrangement according to the present invention.

Figure 2:
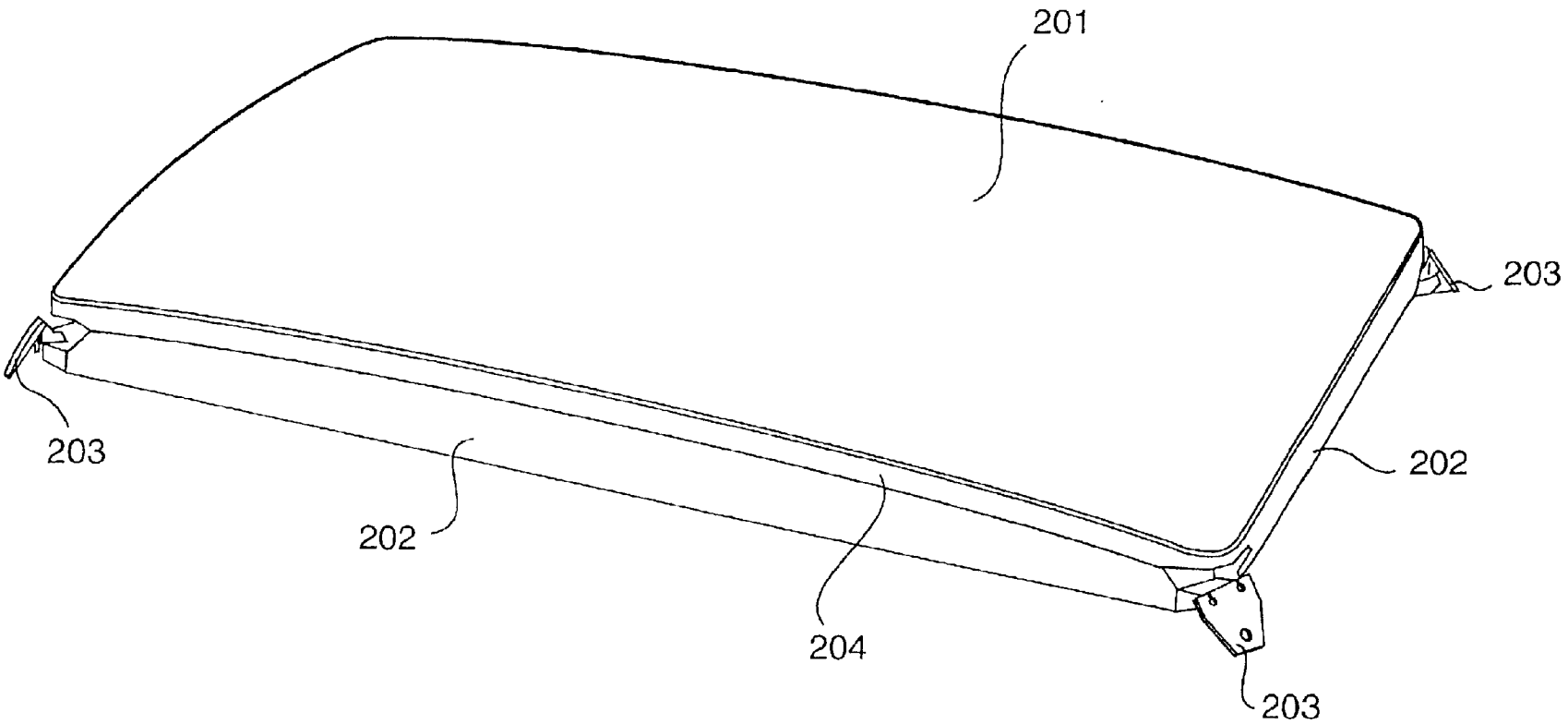

FIG. 2 schematically shows a perspective view of a mask attached to a diaphragm arrangement according to the present invention.

Figure 3:
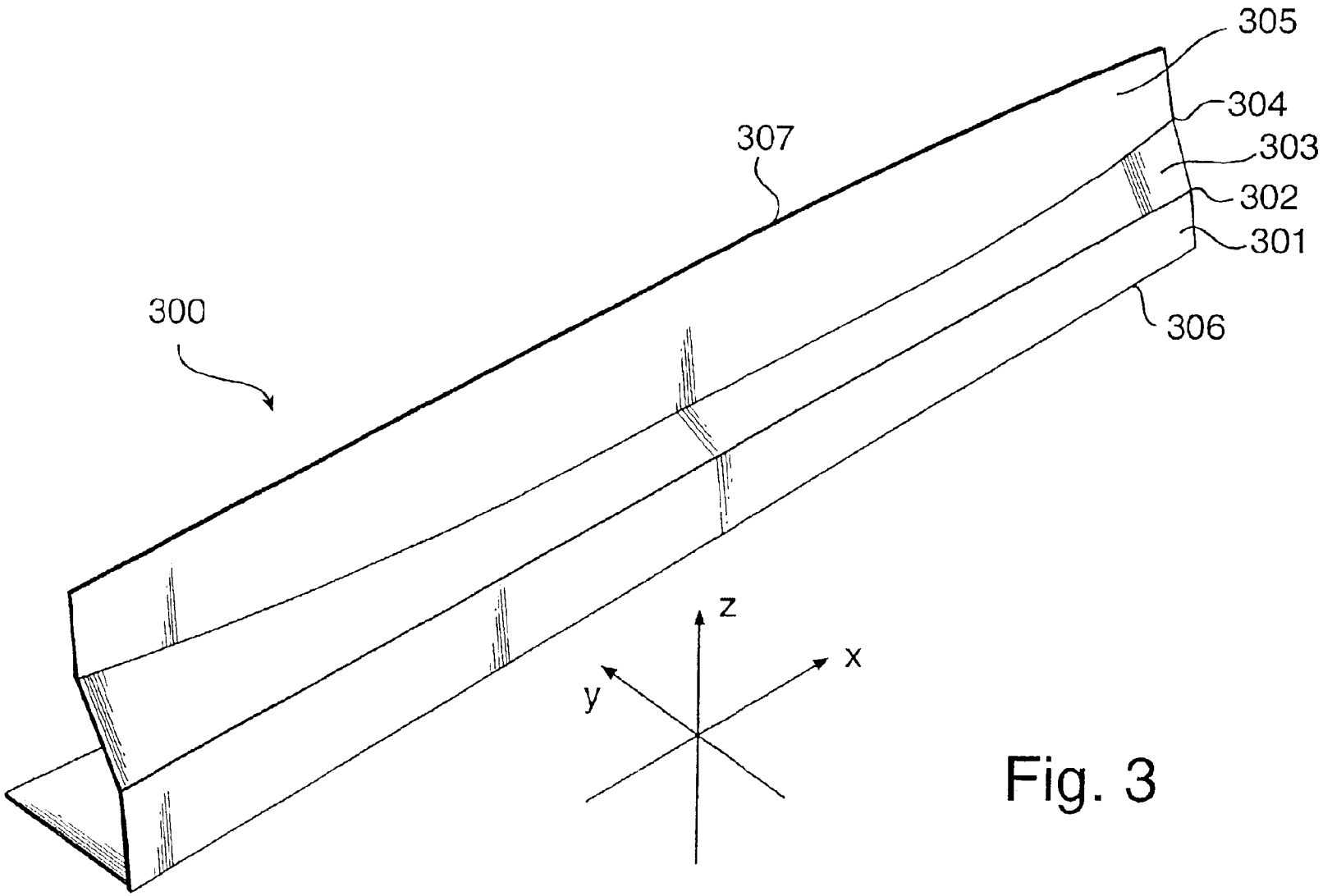

FIG. 3 schematically shows a perspective view of a diaphragm part according to the present invention.

Figure 4A:
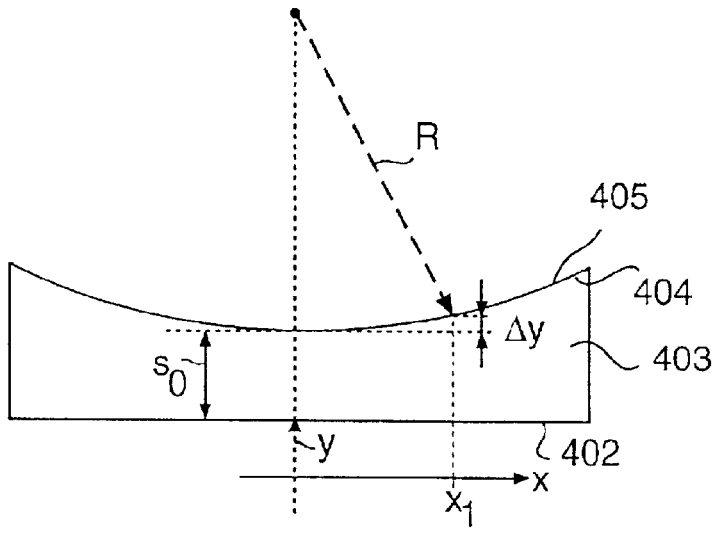

FIG. 4*a* schematically shows a side view of a diaphragm part according to the present invention.

Figure 4B:
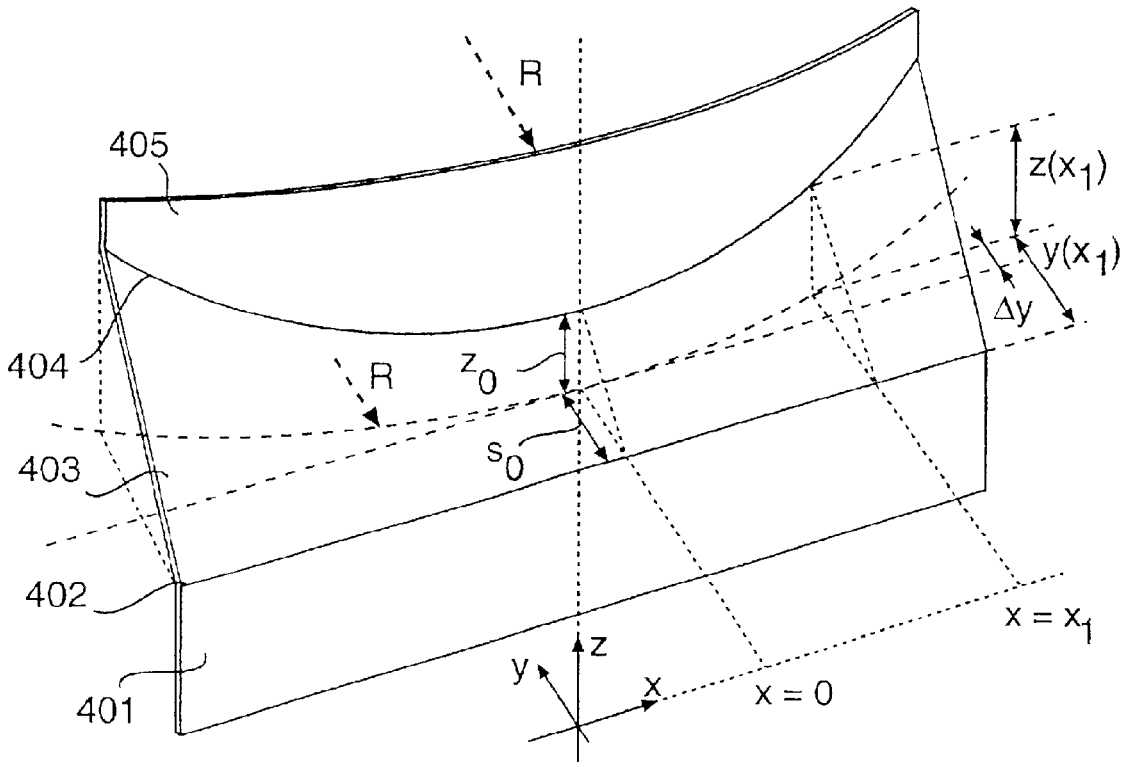

FIG. 4*b* schematically shows a perspective view of the diaphragm part in FIG. 4*a*.

Figure 4C:
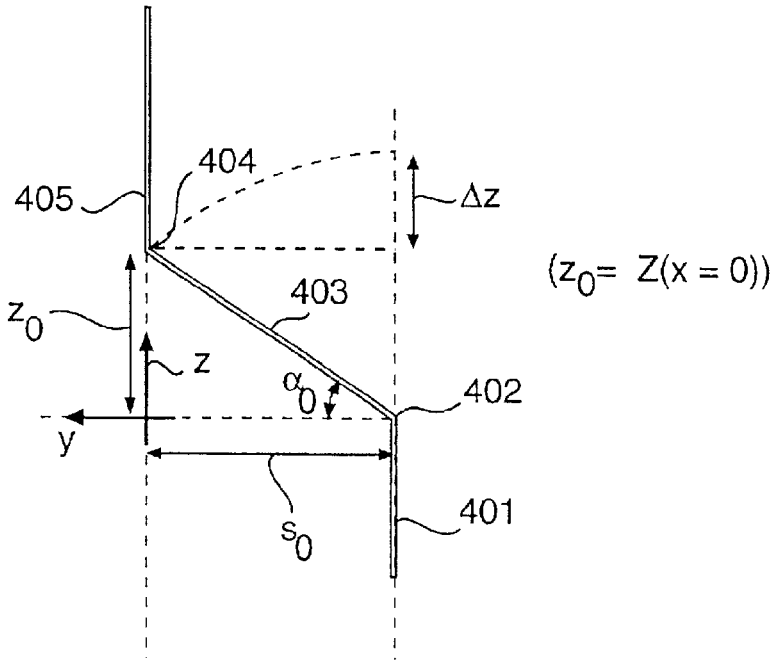
Figure 4D:
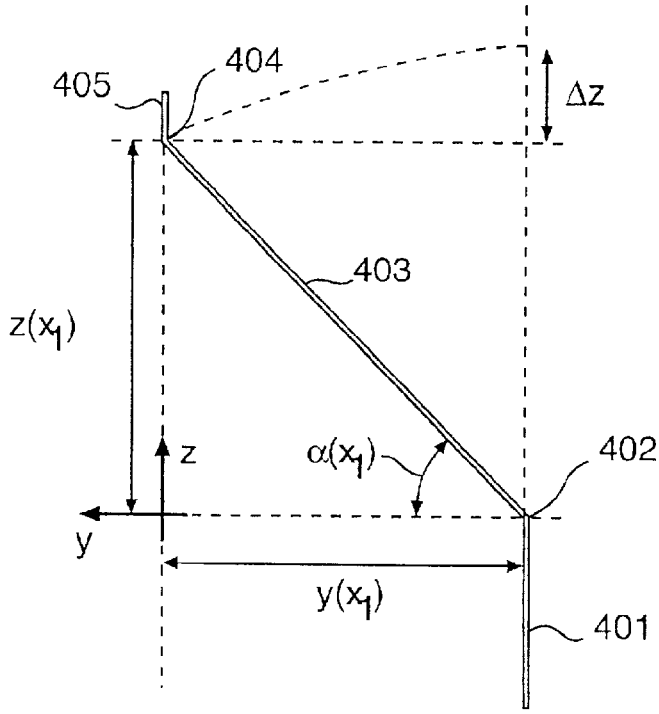

FIGS. 4*c* and 4*d* schematically show cross-sectional views of the diaphragm part in FIGS. 4*a* and 4*b*.

FIG. 1 schematically shows a cross-sectional view of a display tube 101 for use in, e.g., a television apparatus. The tube comprises an electrode system 102 which generates electron beams 103. The electron beams 103 are deflected by means of deflection coils 105 on their way to a luminescent screen 108 at the front end of the display tube. The beams 103 pass through a curved shadow mask 104 on their way to the screen 108. The mask 104 comprising a large number of apertures (not shown), as is known in the art and will be discussed further below, has curved edges.

Although any curve shape may be envisaged, for the sake of simplicity of illustration, a curve shape as defined by a circular curvature radius will be used.

The mask 104 further comprises a skirt portion 109 which serves to provide a certain amount of rigidity to the mask, as well as to provide a means for attaching the mask to a diaphragm arrangement 106. The diaphragm arrangement 106 is attached to the mask 104 and surrounds the mask 104 along the skirt 109.

The diaphragm 106 holds the mask in place within the tube 101 by means of suspension elements 107 which are attached to the diaphragm 106 as well as to the inside of the tube 101, as illustrated in FIG. 1.

FIG. 2 shows in a perspective view a mask 201 with a skirt portion 204. The mask 201 is attached to a diaphragm arrangement comprising four diaphragm parts 202, two of which are visible in FIG. 2. Suspension elements 203 are attached to the diaphragm parts 202 and provide means for suspending the mask 201 and diaphragm arrangement from a display tube, as shown above in connection with FIG. 1.

The material of the mask 201 and the diaphragm parts 202 is electrically conductive and an obvious choice of material is thin sheets of metal.

FIG. 3 shows in greater detail a diaphragm part 300, such as e.g. a diaphragm part 202 shown in FIG. 2. FIG. 3 is a perspective view of the diaphragm part 300, which is aligned along a rectangular co-ordinate system as indicated by the co-ordinate axes (x,y,z).

A sheet of metal has been folded and comprises a first flat portion 301 and a first straight fold 302. The first flat portion 301 provides rigidity to the diaphragm and may also have other effects in terms of interaction with the electron beam (FIG. 1). However, the function of the first flat portion 301 is outside the scope of the present invention and hence will not be discussed further.

From the first straight fold 302 the sheet extends in a first curved portion 303 to a curved fold 304. The curvature of the first curved portion 303 is due to the fact that the angle of folding of the first straight fold varies in the direction along the x-axis.

The curved fold 304 extends in a second curved portion 305 whose shape is such that it is adapted to be attached to a curved part of the skirt of a mask, as shown in FIG. 1 and FIG. 2.

The details regarding the interrelation between the first straight fold and the curved fold 304 will now be discussed in some detail in connection with FIGS. 4*a*–4*d*, in which figures the same reference numerals and symbols refer to one and the same feature of a folded diaphragm part. For the discussion use will be made of a non-limitative example and a description of a mathematical method for making a curved fold without adding mechanical stress to the material used.

FIGS. 4*a*–4*d* show one and the same folded sheet using, in FIG. 4*a* a top view, i.e. a view as seen along the z-axis towards the xy-plane, in FIG. 4*b* a perspective view and in FIGS. 4*c* and 4*d* respective cross sectional views in the yz-plane at two different x co-ordinates, x=0 and $x=x_1$ respectively.

The diaphragm portion comprises a flat portion 401, a straight fold 402, a first curved portion 403, a curved fold 404 and a second curved portion 405.

In the following example, a derivation of a mathematical expression for the curved fold 404 will be presented by way of a number of expressions and using the mathematical notation in FIGS. 4*a*–4*d*. The expression which will be derived describes a family of curves in which a specific curve defining a curved fold which fits a curvature radius R, in the xy-plane, of the shadow mask, may be calculated by selecting two parameters, $S_0$ and $Z_0$.

Referring to FIG. 4*a*, it can be shown that:

$$y(x)=S_0+\Delta y(x) \tag{1}$$

$$\Delta y(x)=R-\mathrm{sqrt}(R^2-x^2) \tag{2}$$

and hence:

$$y(x)=S_0+R-\mathrm{sqrt}(R^2-x^2) \tag{3}$$

Referring now to FIGS. 4*b*–4*d*, where FIG. 4*c* and 4*d* show a cross-section in the yz-plane of the folded sheet at co-ordinates x=0 and $x=x_1$, respectively, we obtain by introducing:

$$\Delta z=\text{constant for every x} \tag{4}$$

and denoting $S_0=y(x=0)$, an expression for Δz at x=0:

$$\Delta z=\mathrm{sqrt}(S_0^2+z_0^2) \tag{5}$$

and an expression for Δz at x:

$$\Delta z=\mathrm{sqrt}(y(x)^2+z(x)^2)-z(x) \tag{6}$$

and since Δz is constant we arrive at:

$$z(x)=(y(x)^2-\Delta z^2)/(2*\Delta z) \tag{7}$$

Using expressions (3) and (7) for y and z as functions of x, with given values for R, $S_0$ and $Z_0$, the curvature of the curved fold and the folding angle α of the straight fold can be calculated. An example of such a calculation is given in the table below for a mask radius R=8620 mm, $S_0$=6.04 mm and $z_0$=3.63 mm.

| x (mm) | y (mm) | z (mm) | α (degrees) |
|---|---|---|---|
| 0 | 6.04 | 3.63 | 31.0 |
| 10 | 6.05 | 3.64 | 31.1 |
| 20 | 6.06 | 3.67 | 31.2 |
| 30 | 6.09 | 3.72 | 31.4 |
| 40 | 6.13 | 3.80 | 31.8 |
| 50 | 6.19 | 3.89 | 32.2 |
| 60 | 6.25 | 4.01 | 32.7 |
| 70 | 6.32 | 4.14 | 33.2 |
| 80 | 6.41 | 4.31 | 33.9 |
| 90 | 6.51 | 4.49 | 34.6 |
| 100 | 6.62 | 4.70 | 35.4 |
| 110 | 6.74 | 4.94 | 36.2 |
| 120 | 6.88 | 5.21 | 37.1 |
| 130 | 7.02 | 5.50 | 38.1 |
| 140 | 7.18 | 5.83 | 39.1 |
| 150 | 7.35 | 6.19 | 40.1 |
| 160 | 7.53 | 6.58 | 41.2 |
| 170 | 7.72 | 7.00 | 42.2 |
| 180 | 7.92 | 7.47 | 43.3 |
| 190 | 8.13 | 7.97 | 44.4 |
| 200 | 8.36 | 8.52 | 45.5 |
| 210 | 8.60 | 9.11 | 46.7 |
| 220 | 8.85 | 9.75 | 47.8 |
| 230 | 9.11 | 10.43 | 48.9 |
| 240 | 9.38 | 11.17 | 50.0 |

In order to fold a sheet according to the expressions (3) and (7), resulting in co-ordinates for the curved fold 404 and angles of folding α for the straight fold 402 according to the table above, a folding tool has to be produced and used.

A method of manufacturing a diaphragm part having the general shape as shown in, e.g., FIG. 3 will involve a number of steps. Those steps include the creation of a straight fold 302 having a constant folding angle $\alpha_0$, followed by a step of folding the sheet extending from the straight fold into a curved fold 304 in accordance with expressions (3) and (7) and thus generating a curved portion 303 between the straight fold 302 and the curved fold 304.

The diaphragm arrangement thus comprises three different sections: a curved section which follows the contour of the mask, a rectangular section which serves as a frame and a transition section between the curved section and the rectangular section. In plain words, the function of the transition section is to act as a bridge between the curved section and the rectangular section.

As illustrated in the example above, the straight fold has a varying folding angle and the curved fold follows a curve which enables the transition from the straight fold to the curved fold to provide a folded sheet which is free from inherent mechanical stress.

Although the embodiment of the invention described herein comprises one straight fold and one curved fold, it is of course possible to manufacture diaphragm parts having a plurality of folds. As long as the design rule of equation (4) is followed for each fold, any number of folds or combination of folds, straight and curved, may be provided.

What is claimed is:

1. Display arrangement comprising a cathode ray tube, inside which tube a mask with at least one curved outer edge is located, said mask being at least partly attached by at least part of the curved edge to the tube by means of at least a diaphragm arrangement, wherein said diaphragm arrangement comprises at least one diaphragm part in the form of an elongated folded sheet with a reduced level of in-plane mechanical stress, said sheet comprising:

a straight fold, the sheet extending from the straight fold to a curved fold, and the sheet extending from the curved fold to a curved part of the sheet for attaching to the curved mask edge.

2. Display arrangement according to claim 1, wherein the straight fold has a varying folding angle α.

3. Display arrangement according to claim 2, wherein said curved fold follows a circular curvature radius.

4. Display arrangement according to claim 3, wherein the diaphragm arrangement comprises a plurality of diaphragm parts attached to the curved edge of the mask and a plurality of suspension units attached to the diaphragm parts.

5. Display arrangement according to claim 2, wherein the diaphragm arrangement comprises a plurality of diaphragm parts attached to the curved edge of the mask and a plurality of suspension units attached to the diaphragm parts.

6. Display arrangement according to claim 1, wherein said curved fold follows a circular curvature radius.

7. Display arrangement according to claim 6, wherein a rectangular co-ordinate system, can be oriented such that the straight fold lies along the x-axis and the position of the curved fold substantially satisfies the equation:

$$y(x)=S_0+R-\mathrm{sqrt}(R^2-x^2),$$

$$z(x)=(y(x)^2-\Delta z^2)/(2*\Delta z),$$

where:

Δz is constant for all values of x and equals $\mathrm{sqrt}(S_0^2+z_0^2)-z_0$,

R is the curvature radius in the xy-plane of the mask edge, and $S_0=S(x=0)$, $z_0=z(x=0)$ are dimensional constants whose values depend on dimensions relating to the display arrangement.

8. Display arrangement according to claim 7, wherein the diaphragm arrangement comprises a plurality of diaphragm parts attached to the curved edge of the mask and a plurality of suspension units attached to the diaphragm parts.

9. Display arrangement according to claim 6, wherein the diaphragm arrangement comprises a plurality of diaphragm parts attached to the curved edge of the mask and a plurality of suspension units attached to the diaphragm parts.

10. Display arrangement according to claim 1, wherein the diaphragm arrangement comprises a plurality of diaphragm parts attached to the curved edge of the mask and a plurality of suspension units attached to the diaphragm parts.

11. Method of manufacturing a diaphragm part in the form of an elongated sheet with a reduced level of in-plane mechanical stress, which sheet is used in a display arrangement according to claim 1, said method comprising the following steps:

creating a straight fold, creating a curved fold such that the sheet extends from the straight fold to the curved fold, and such that the sheet extends from the curved fold to a curved part of the sheet for attaching to the curved mask edge.

12. Method according to claim 11, wherein said creation of the straight fold entails creating a fold with a varying folding angle α.

13. Method according to claim 12, wherein said creation of the curved fold entails creating a fold following a circular curvature radius.

14. Method according to claim 11, wherein said creation of the curved fold entails creating a fold following a circular curvature radius.

15. performing the method of claim 14, such that a rectangular co-ordinate system, can be oriented so that the straight fold lies along the x-axis and the position of the curved fold substantially satisfies the equation:

$$y(x)=S_0+R-\text{sqrt}(R^2-x^2),$$

$$z(x)=(y(x)^2-\Delta z^2)/(2*\Delta z),$$

where:

$\Delta z$ is constant for all values of x and equals $\text{sqrt}(S_0^2+z_0^2)-z_0$, R is the curvature radius in the xy-plane of the mask edge, and $S_0=S(x=0)$, $z_0=z(x=0)$ are dimensional constants whose values depend on dimensions relating to the display arrangement.

16. Diaphragm arrangement for use in a display arrangement comprising a cathode ray tube, inside which tube a mask with at least one curved outer edge is located, said mask being at least partly attached by at least part of the curved edge to the tube by means of the diaphragm arrangement, wherein said diaphragm arrangement comprises at least one diaphragm part in the form of an elongated folded sheet with a reduced level of in-plane mechanical stress, said sheet comprising:

a straight fold, the sheet extending from the straight fold to a curved fold, and the sheet extending from the curved fold to a curved part of the sheet for attaching to the curved mask edge.

17. Diaphragm arrangement according to claim 16, wherein the straight fold has a varying folding angle $\alpha$.

18. Diaphragm arrangement according to claim 16, wherein said curved fold follows a circular curvature radius.

19. Diaphragm arrangement according to claim 18, wherein a rectangular co-ordinate system, can be oriented such that the straight fold lies along the x-axis and the position of curved fold substantially satisfies the equation:

$$y(x)=S_0+R-\text{sqrt}\ (R^2-x^2),$$

$$z(x)=(y(x)^2-\Delta z^2)/(2*\Delta z),$$

where:

$\Delta z$ is constant for all values of x and equals $\text{sqrt}(S_0^2+z_0^2)-z_0$, R is the curvature radius in the xy-plane of the mask edge, and $S_0=S(x=0)$, $z_0=z(x=0)$ are dimensional constants whose values depend on dimensions relating to the display arrangement.

20. Diaphragm arrangement according to claim 16, wherein said curved fold follows a circular curvature radius.

* * * * *